US006510666B1

(12) United States Patent
Thompson

(10) Patent No.: US 6,510,666 B1
(45) Date of Patent: Jan. 28, 2003

(54) SHEATHING TIE DOWN

(76) Inventor: Thomas C. Thompson, 92-543 Kokole Pl., Makakilo, HI (US) 96707

( * ) Notice: Subject to any disclaimer, the term of this patent is extended or adjusted under 35 U.S.C. 154(b) by 0 days.

(21) Appl. No.: 09/710,116

(22) Filed: Nov. 10, 2000

Related U.S. Application Data

(63) Continuation-in-part of application No. 09/227,059, filed on Jan. 7, 1999, now abandoned.

(51) Int. Cl.[7] ..... E02D 27/02

(52) U.S. Cl. ..... 52/712; 52/264; 52/489.1; 52/715; 52/714; 52/713

(58) Field of Search ..... 52/112, 547, 520, 52/23, 700, 712, 511, 509, 92.2, 93.1, 167.1; 403/389

(56) References Cited

U.S. PATENT DOCUMENTS 3,889,441 A * 6/1975 Fortine ..... 52/715
4,665,672 A * 5/1987 Commins et al. ..... 52/295
4,896,985 A * 1/1990 Commins ..... 403/11
5,150,553 A * 9/1992 Commins et al. ..... 52/264
5,390,460 A * 2/1995 Llorens ..... 52/489.1
5,423,156 A 6/1995 Nellessen
5,560,156 A * 10/1996 McDonald ..... 52/92.2
5,595,031 A * 1/1997 Commins ..... 52/264
5,640,822 A * 6/1997 Haswell ..... 52/712
6,094,880 A 8/2000 Thompson ..... 52/712

* cited by examiner

*Primary Examiner*—Carl D. Friedman
*Assistant Examiner*—Basil Katcheves

(57) ABSTRACT

A connector that securely ties together sheathing and the underlying structural members on a building. The connector consists of a rafter web on the bottom that can be attached to the vertical face of a structural member. A right angle bend connects to a normal web that aligns against the edge of sheathing. Another right angle bend connects to an offset web and sheathing web that can be attached to the broad surface of sheathing and underlying member. The connector can fit on a variety of thickness or shape of sheathing, and a variety of beam widths. The connector helps prevent and transfer uplift and lateral forces during strong winds and seismic movements.

10 Claims, 12 Drawing Sheets

SHEATHING TIE DOWN

This is a CIP of U.S. Ser. No. 09/227,059 filed Jan. 7, 1999 now abandoned. This invention relates to an innovative connector that positively holds down sheathing to create buildings that are stronger and more resistant to earthquakes, hurricanes, and strong winds.

BACKGROUND

1. Field of Invention
2. Description of Prior Art

Background

Recent studies of hurricane damage on wood-frame buildings indicate that the most extensive destruction to a house by strong winds, was when the roof sheathing was torn off and rain ruined everything in the house.

Roof sheathing ties all the rafters together on a wood frame house, and the roof sheathing tries all the roof trusses together when a masonry or wood-frame house is constructed with trusses. The roof sheathing helps prevent the trusses from racking, or tilting perpendicular to their length.

Sheathing that is tightly secured to the roof and subsequently fastened to the walls, helps transfer uplifting forces to the walls and henceforth to the foundation. If the roof sheathing fails, the trusses collapse, and the walls usually fall down as they can not stand by themselves against strong winds.

Failure and loss of the roof sheathing is common during hurricanes, mainly because of inadequate fastening of the roof sheathing to the underlying structural members. The roof system provides stability to a house by bracing the tops of exterior and interior load-bearing walls.

Sheet metal joints perform better than nailed joints in high winds and during seismic activity. Strong connectors, secured by well placed fasteners, will insure that the major structural members of a house are securely tied together.

Hurricanes

Studies of damage after Hurricane Andrew show several problems with the attachment of roof sheathing that this invention solves. Some sheets of roof sheathing that were blown off houses contained no nail holes, indicating that the sheet was placed in position, but was not nailed down. Some roofing sheets had nails in them that had missed the rafter that they should have been nailed upon. Some sheets had staples or nails that had rusted away, and on some sheets the nails had just pulled out from the rafter.

The engineering staff of the American Plywood Association provided technical personnel to assess the damage from Hurricane Andrew in Florida. The majority of wood structural sheathing failures were attributed to improper connection details, and in every case investigated, the sheathing loss was a result of improper nailing (Keith, 1992).

These problems have not been solved because staples are still used to tie down roof sheathing, and by looking at new construction, nails are still seen poking through the roof sheathing, completely missing the roof rafter. Most conscientious framers would drive another nail when they felt the nail miss the underlying rafter, but with the new powered nail guns, the framer can not tell if the rafter was missed because each shot feels the same, no matter what the nail is being driven into.

Earthquakes

During an earthquake, the floor, wall, and roof diaphragms undergo shearing and bending. The shear forces from the roof boundary members are transferred to the top of the shear wall by way of toenails or blocking to the top plate. To withstand and transfer the shear loads, plywood sheets have to be spliced together to prevent adjoining edges from sliding past or over each other (Gray, 1990).

Butted together on the centerline of a 2× (nominally 1½-inches-wide), you've only got ¾ inch bearing for each plywood sheet, so the nail has to be ⅜ inch from the edge. This leaves little margin for error, and nailing has to be done with care to avoid splitting the plywood and missing or splitting the underlying member (Gray, 1990).

Tests at the University of California show that plywood secured by overdriven nails, nails that penetrated the plywood beyond the first veneer (usually by a powered nailgun), failed suddenly and at loads far below those carried by correctly nailed plywood panels (Gray, 1990).

Steel connectors, between different components of a wood-frame building's superstructure, provide continuity so that the building will move as a unit in response to seismic activity (Yanev, 1974).

Prior Art

A number of connectors have been developed to tie together the structural members of a house under construction. Up until this invention, nobody had seen how to make a compact connector that could tie two or more sheathing sheets together and to the underlying structural members, or could be applied from the top of the roof.

Some prior art prevents uplift, but this invention not only prevents uplift during hurricane-force winds, but prevents lateral movement during earthquakes.

A previous sheathing tie that wrapped around a structural member and attached to the sheathing by a different method, is on application Ser. No. 09/227059 sent in Jan. 7, 1999.

The Simpson Strong-Tie Co.'s January 1996 catalog (page 62) lists a PSCL Plywood Sheathing Clip. This clip provides a gap and aligns sheathing but does not tie the sheathing to underlying structural members or prevent uplift or lateral movement. No other sheathing ties were found in their catalog, but they do show several seismic and hurricane ties on pages 60–61.

Several of their ties "neck down" at right angle bends. The H2, H2.5, H3, H4, H5, and H7 become narrower at their right angle bends. This is also seen on the flat pattern layout for the H4 and H5 on U.S. Pat. 4,714,372 by Commins. The "notch effect" shown in this patent is also avoided on my invention because of the smooth bends and edges.

A prior art roof securing system by Llorens, U.S. Pat. No. 5,390,460 ties down a single sheet of roof sheathing to a support beam. This is a good connector, but it is long, and can only tie down one-size of sheathing. It must be hammered around the beam from below, but panels are installed from above the roof. Llorens' 460 can only tie down one panel and provides little lateral support.

Another sheathing strap and alignment guide by Nellessen, U.S. Pat. No. 5,423,156 shows an apparatus for securing sheathing using a long strap, connecting bands, and saddles. This is a good connector, but it is long, complicated, and must be installed from below the roof. With sheathing in place, this is difficult. Nellessen's 156 can only tie down panels of one size.

According to Fine Homebuilding, October/November, 1998, sheathing courses should begin with either a full or half sheet. The course of sheathing at the top row and beginning row are often odd-size, in order to get a reasonable width of sheathing on the top row. The above can't tie down odd-size sheets.

Objects and Advantages

Accordingly, several objects and advantages of my invention are that it helps secure the roof, wall, and floor of a building to keep the building from being destroyed by hurricanes, tornadoes, and earthquakes.

This invention helps prevent the wall of a building from detaching from the wall studs during a hurricane or earthquake. It makes the wall into a stable shearwall, transferring shear forces into the foundation and ground.

This invention helps prevent the roof of a building from detaching from the rafters or roof trusses during a hurricane. It ties the roof sheathing securely to the underlying rafter or roof trusses, transferring lateral and uplift forces to the walls and to the foundation.

This invention helps prevent the floor of a building from detaching from the floor joists during an earthquake. It makes the floor into a horizontal shear wall, and helps the floor resist lateral forces in its horizontal plane. It also makes sure that any forces transferred from the roof and wall can be managed by the floor and transferred properly to the ground.

One object of this invention is to make each plywood structure on a house into a shearwall, that is, able to transfer forces without breaking or disconnecting. By tying the plywood securely to the underlying structural member, the plywood can reliably transfer and dissipate shear, lateral, and uplift forces to the ground.

During an earthquake or a hurricane, another object is for the building with my invention to move as a sturdy unit, resisting and transferring destructive forces to the ground. Mounted on the roof sheathing and rafter, my invention resists uplift, the most destructive force during a hurricane. Mounted on the wall stud and wall sheathing, my invention prevents the wall sheathing from being blown off or sucked out by the extreme negative pressure of a hurricane. Mounted on the floor sheathing and floor joists, my invention prevents the floor from separating, if it should get wet during a hurricane.

During an earthquake, when my invention is mounted on the roof, walls, and floors, they will turn each member into a shear wall. The secured plywood will absorb and dissipate earth movements, without becoming detached from the underlying structural members. It will also prevent the sheathing from sliding over or past each other.

This could improve a house to existing building codes, as sheet metal joints have been proven to perform better than nailed joints during hurricanes and earthquakes.

Another object of this invention is the large surface area on the top or outside part of the sheathing. This area prevents the plywood sheathing from splitting during nailing. The large surface area provides more strength in the hold-down process.

Still another advantage is the accurately placed nail holes on the invention. These nail holes prevent nails from splitting the plywood or underlying rafter, stud, or joist, by making the framer place nails at the correct and accurate location.

Another advantage is that the invention prevents overdriven nails from penetrating the fragile outer veneer of the plywood sheathing. The accurately placed nail holes prevent the nailhead from piercing the outer veneer of the plywood.

Another advantage is that some nails, on the invention, are driven into the strong broad side of a rafter, stud, or joist, forming a very strong connection to the sheathing, preventing the nails from pulling out.

Yet another advantage of this invention is during earthquakes, nails can sometimes bend with the movements of the house, but screws often break. Even though screws hold tighter than nails and provide a tight connection against uplifting forces from hurricanes, they are less resistant against earth movements. This invention absorbs and transmits most of the forces during an earthquake and hurricane so nails and/or screws can be used as fasteners.

Another advantage is that since the invention absorbs and transfers earthquake and hurricane forces, less nails and nailing could be used. Also, screws could be used in the invention in earthquake areas with less fear that the heads will shear off.

Still another advantage of the invention is in the ability to prevent plywood sheets from sliding past or over each other during an earthquake. Previously, only nails had to shear, but this entire connector must be sheared for the plywood to slide.

Another advantage is that plywood panels should not be butt together tightly or they may buckle when they expand due to heat or humidity. A slight gap should be left between panels. This invention provides a slight gap next to each plywood panel that the invention is installed upon.

Still another advantage is that with the roof sheathing firmly attached to the rafters, roofing material will have a better chance of staying on during strong winds and earth movements. In addition, with the sheathing firmly connected, new materials may be attached to the roof, such as solar electric panels, without fear of them being blown off.

In areas with brush or forest fire danger, fire-proof material or heavy material, such as tile, stone or metal, can be applied to the roof with less danger of being blown or shaken off during earth tremors or high winds.

When the invention is applied to the studs and wall sheathing, fire-proof materials such as stucco or brick veneer can be applied to the sheathing with less chance of being shaken off during earth movements.

When the invention is applied to the floor joists and floor sheathing, the interior load-bearing walls can have a horizontal shear wall, inside the house, to help transfer earth movements.

Earth tremors and hurricanes always destroy the weakest parts of a house. By making each envelope of a house, the vertical walls, horizontal floors, and roof envelope into a strong unit, there will be less damage.

Another advantage is that the building contractor or a building inspector can visually inspect the roof sheathing, wall sheathing, and flooring for correct tie down, and can be assured that all the nails have been correctly placed. Previously, a visual inspection could not determine if the sheathing or flooring was properly applied and secured.

Still another advantage is that the invention can hold down standard-size or odd-size sheathing. According to Fine Homebuilding, October/November, 1998, sheathing courses should begin either with a full or half sheet. The course at the top row and beginning row are often odd-size, so that a reasonable width of sheathing is on the top row.

An advantage is that the framer can more accurately determine where the underlying structural member is located because the tie is on top of the sheathing, in line with the member.

Another advantage is the invention is easily used with current framing methods. The invention is installed from the top side of the sheathing so the framer doesn't have to go under the sheathing, which can be dangerous.

Nailguns can be used to attach this invention if the nail protrudes from the gun, prior to being driven. Nailguns can be used to apply nails to the sheathing and underlying rafter in-between the installed inventions, just like conventional construction. Screw guns can be used as well.

Still another advantage of this invention is when it is applied to the floor joist and floor sheathing, it will keep each sheet of sheathing a slight distance from each other helping prevent squeaks. Also, after a house is built, the wood floor joists and plywood shrink at different rates, causing gaps between them. By being tightly secured with my invention, any gaps will be insignificant, averting any squeaks.

Still another object is that the invention is thin so that a covering or underlayment can be easily applied. There is no "notch" effect where sharp corners or bends can cause stress points. All bends and edges are smooth. The rafter web, offset web, and sheathing web are constant width for strength.

It is a further object of this invention that it easily, quickly, and economically protects houses from the destructive forces of earthquakes and hurricanes. It is a still further object that the connectors and fasteners are strong, attractive, permanent, functional, uncomplicated, simple to manufacture, easy to install, and economical. All of the embodiments can be made from a single sheet metal blank, without any welding.

A further object is that this invention can be used on various size sheathing, rafters, roof trusses, studs, wood or metal I-beams, all made from wood or metal. There may be insurance discounts for homeowners who have this invention installed on their houses.

Previously, architects, engineers, and builders did not know how important the attachment of plywood sheathing was to the roof, walls, and floors. It was thought that the weight of the roof would keep the sheathing attached during a storm. Prior to this invention, no thought had been given to the floor as a horizontal shear wall during an earthquake.

Older homes were built with rafters 16-inches-on-center, but newer homes are built 24-inches-on-center. This means there are less nails per sheathing sheet than before. The holding power of this invention more than compensates for the less nails. Adhesive foam has been used to hold down sheathing, but it can shrink and lose holding capacity. Another advantage is this invention will last the life of the house, with full holding capacity.

A further advantage of this invention is that different thicknesses of sheathing can be attached using the same component. There is no need to buy different types of clips for houses using different thicknesses or density of sheathing, because this invention will work with any depth including metric.

This invention will hold down any thickness of wood sheathing, metal sheathing, composite sheathing, or insulating sheathing using just one single type of component. This saves manufacturing, shipping, and inventory storage of components, since one size fits all. The invention nests during manufacture, saving metal, and nests during packaging, saving space.

Another advantage is that this invention can hold down different thickness of sheathing to different width structural members such as 2×4's, 2×6's, 2×8's, etc. It can securely hold sheathing to solid wood members, trusses, hollow beams, engineered beams, and laminated beams. The invention works on beams that are horizontal, vertical, or sloped.

These and other objectives of the invention are achieved by a simple and economical connector that allows a builder to quickly and easily secure sheathing to structural beams, making a building resistant against earth tremors and high winds.

Advantages will be discussed in the description. Further objects and advantages of my invention will become apparent from a consideration of the drawings and ensuing description.

Reference Numerals

Figure 1:
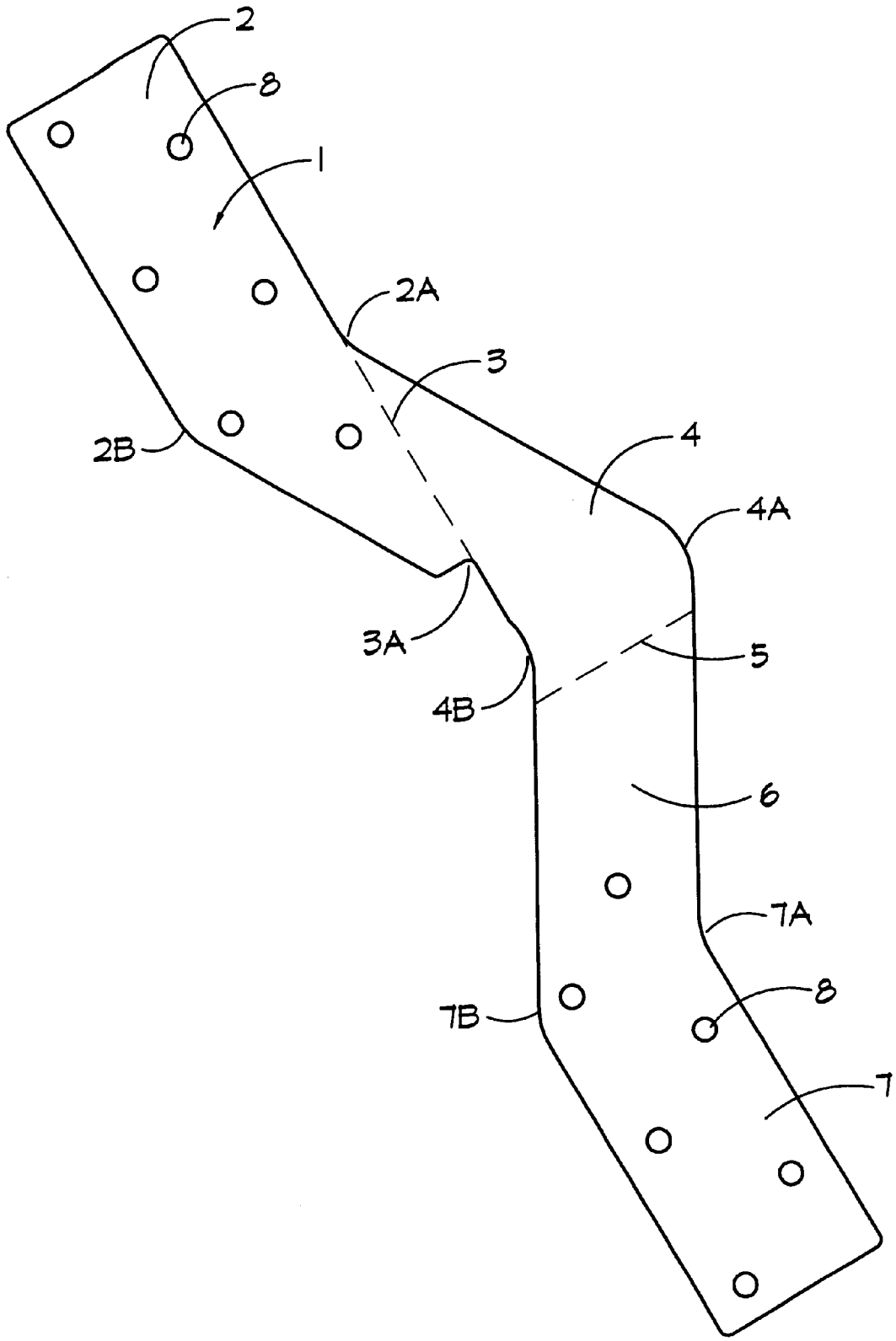
FIG. 1 is a flat pattern layout of a universal sheathing tie.

1. Left-hand universal sheathing tie
2. Rafter web
2A. Inner lower jog
2B. Outer lower jog
3. Space bend
3A. Relief
4. Normal web
4A. Outer middle jog
4B. Inner middle jog
5. Universal bend
6. Offset web
7. Sheathing web
7A. Inner upper jog
7B. Outer upper jog
8. Nail holes
9. Right-hand universal sheathing tie
10. Reverse left-hand universal sheathing tie
11. Reverse right-hand universal sheathing tie
12. Nail
R. Rafter
S. Sheathing

Description

FIG. 1

Refer now to FIG. 1 which shows a flat pattern layout of a universal sheathing tie 1. This is the same tie as shown on FIG. 7 in my prior application Ser. No. 09/227,059 which is incorporated by reference.

The universal sheathing tie is so named because it can tie down different thicknesses of sheathing, can attach to different widths of rafters, and can be used on rafters, trusses, engineered beams, or studs. Sheathing thicknesses can range from about ¼- to 1-inch, and the universal sheathing tie can tie all of them down.

Rafter thickness can range from 2×4's past 2×12's, and the universal sheathing tie can into all of them. The universal sheathing tie can attach to structural beams consisting of stacked 2× lumber, trusses, engineered I-beams composed of wood, and steel-frames of manipulated sheet metal.

The universal sheathing tie can tie down odd-size sheets of sheathing, as ½ sheets and unusual widths of sheathing can be used on a house with gables and dormers. The universal sheathing tie could be used to tie down roof sheathing, wall sheathing, and floor sheathing.

The universal sheathing tie 1 consists of a rafter web 2 which is rectangular on one end and triangular at the other end with a curved relief 3A. The rafter web 2 has nail holes 8 for attachment to the broad side of a rafter or truss.

An inner lower jog 2A, and outer lower jog 2B curve the rafter web 2 forming the triangular shape. A right-angled bend line extending off the long side of the rafter web 2 near the curve of the inner lower jog 2A is called the space bend 3.

The space bend 3 forms a triangular section known as a normal web 4. At the top end of the normal web 4 is a curve consisting of an inner middle jog 4B and outer middle jog 4A. The curve of the inside middle jog 4B is the terminus of the space bend 3.

On the other side of the middle jogs 4A and 4B is a right-angled bend, known as the universal bend 5, that is generally perpendicular to the space bend 3. On the other side of the universal bend 5 is a generally rectangular section called the offset web 6.

The offset web 6 has a curve at the other end formed by the inner upper jog 7A and outer upper jog 7B. Next to the upper jogs 7A and 7B, the rectangular sheathing web 7 has nail holes 8 for attachment to the sheathing and underlying structural member.

FIG. 2

Figure 2:
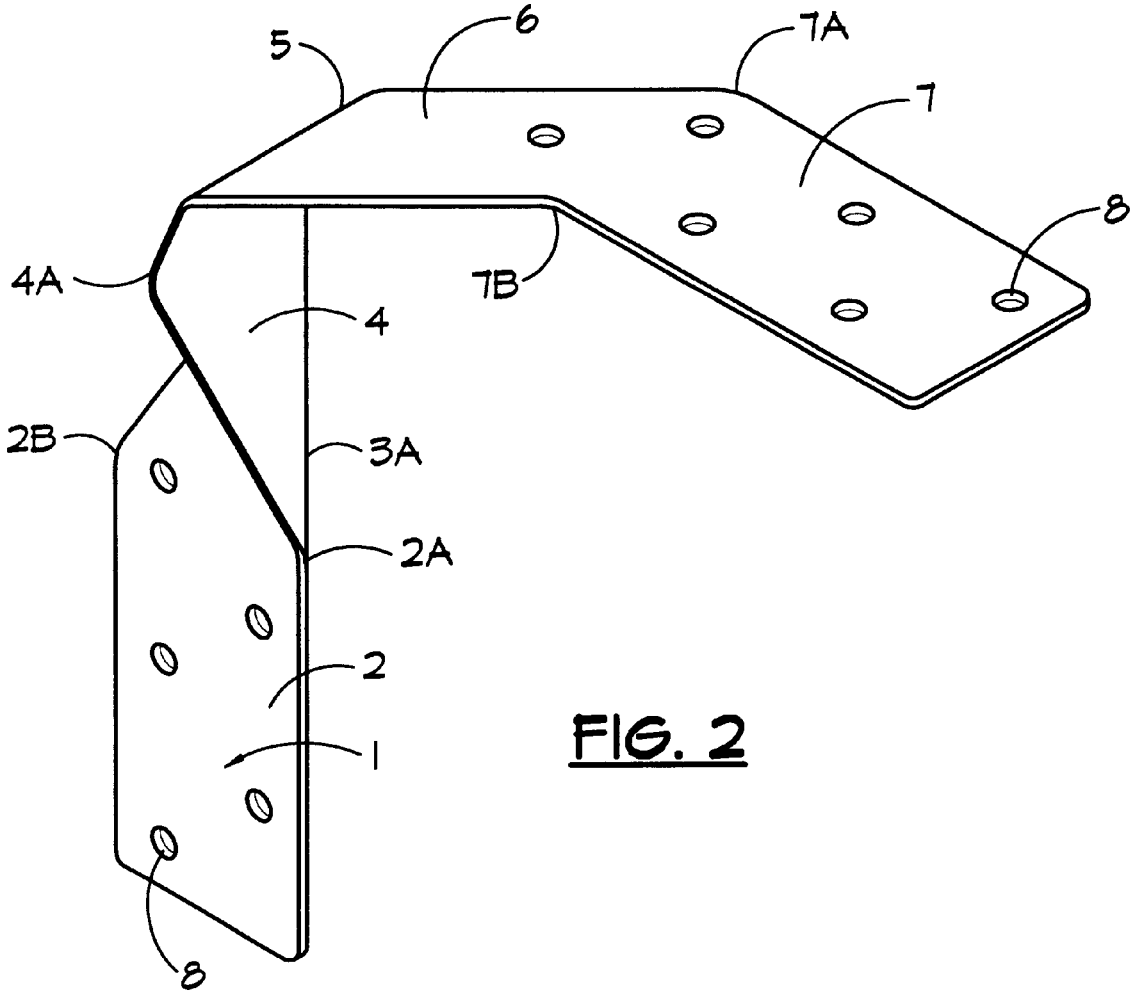
FIG. 2 is a perspective view of a universal sheathing tie.

Refer now to FIG. 2 which is a perspective view of a universal sheathing tie 1 after bending. The space bend 3 can be bent at a right angle in either direction forming a left- or right-hand universal sheathing tie 1.

The rafter web 2 is at the bottom of the tie, and the normal web 4 is perpendicular to the rafter web by way of the right angle bend at the space bend 3. The normal web 4 is now offset from the rafter web 2.

The outer middle jog 4A and inner middle jog 4B start curving the tie in the opposite direction until the right angle universal bend 5 bends the generally parallelogram-shaped offset web 6 perpendicular to the normal web 4. The relief 3A is hidden under the offset web.

The offset web 6 continues offsetting until the outer and inner upper jogs 7A and 7B curve the sheathing web 7 in the other direction. This places the sheathing web 7 above, perpendicular, offset, and transverse to the rafter web 2.

FIG. 2A

Figure 2A:
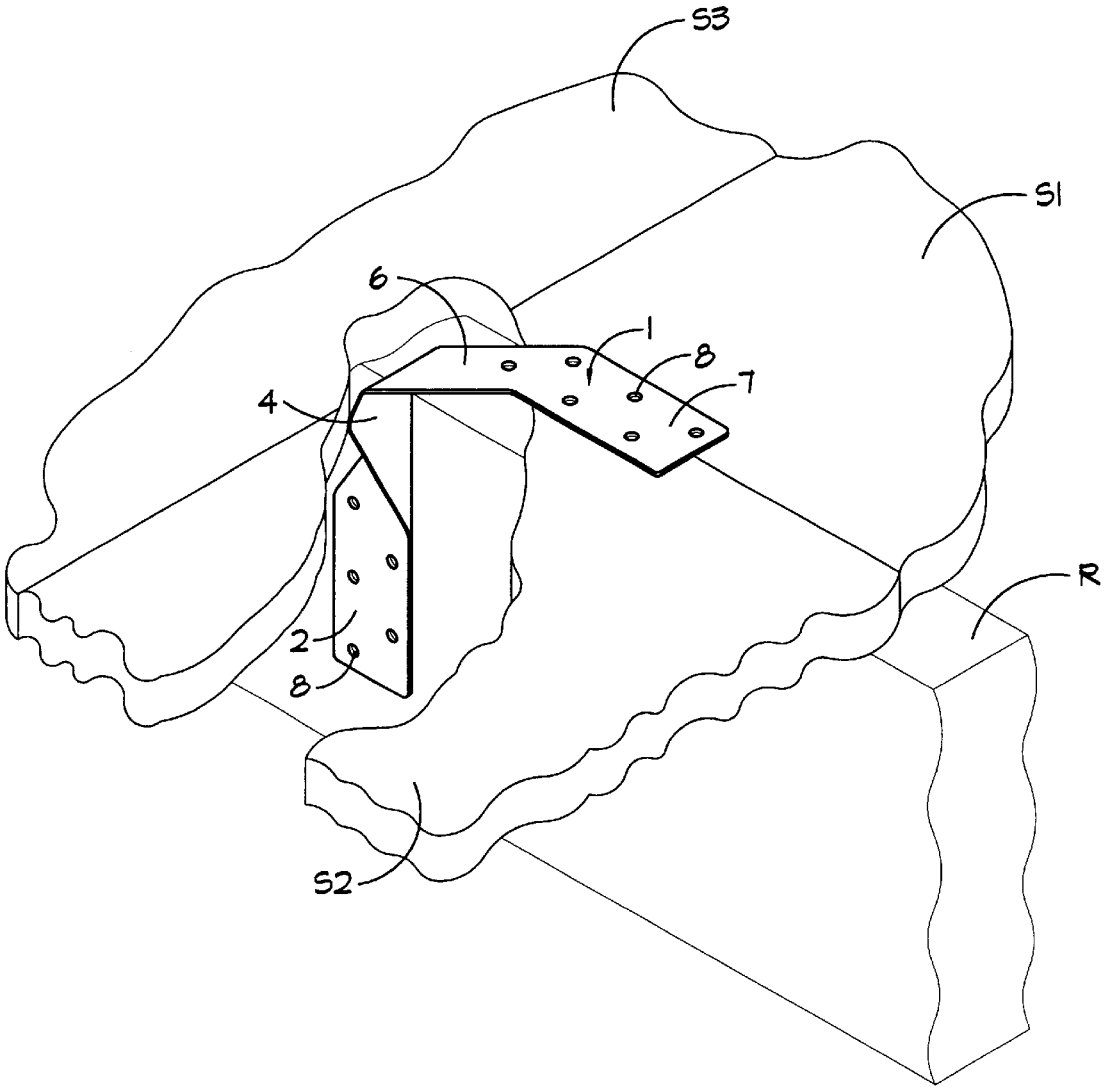
FIG. 2A is a perspective view of a left-hand universal sheathing tie mounted on a house.

Refer now to FIG.2A which shows a perspective view of a left-hand universal sheathing tie 1 installed on a building holding down roof sheathing to a rafter. The rafter web 2 is attached to the rafter R with nails through nail holes 8. Two sheets of sheathing are secured to the rafter R by nails driven through nail holes 8 on the sheathing web 7.

Sheets of sheathing are laid down so the ends butt next to each other over the centerline of the underlying rafter or roof truss for good support. On a 2×6 rafter, the width is only 1½-inches. This means about ¾-inch is available for placement and attachment of each edge of sheathing to the rafter.

Framers can often split off the edge of the underlying rafter by driving a nail too close to the edge. Sometimes the butt edges of the sheathing sheets S1 and S2 will be aligned so one sheet has 1-inch on the rafter and the other sheet has only ½-inch on the rafter. The universal sheathing tie 1 will hold down the weak edges of sheathing and the weak corner edges of sheathing.

After the sheathing is laid down, the underlying rafter is invisible to the framer. The universal sheathing tie's wide sheathing web 7 helps hold down the sheathing, and provides visual alignment for the underlying rafter R. The nail holes 8 on the sheathing web 7 guide the nails into the meat of the rafter.

Referring to FIG. 2A, after sheathing sheets S1 and S2 are laid down on the rafter R, a universal sheathing tie 1 is installed. The curved relief 3A allows different thicknesses of sheathing to be secured. The universal sheathing tie 1 is slid down the edge of sheathing sheets S1 and S2 until the sheathing web 7 is flush against the sheathing. The normal web 4 is flush against the edge of the sheathing S2, so the rafter web 2 is sticking out from the sheathing S2, flush against the rafter R.

The rafter web 2 is easily attached to the wide side of the rafter R and the sheathing web 7 is attached to the sheathing S1 and S2 and the thin edge of the rafter R by nails through nail holes 8. Another sheet of sheathing S3 can then be installed.

FIG. 2B

Figure 2B:
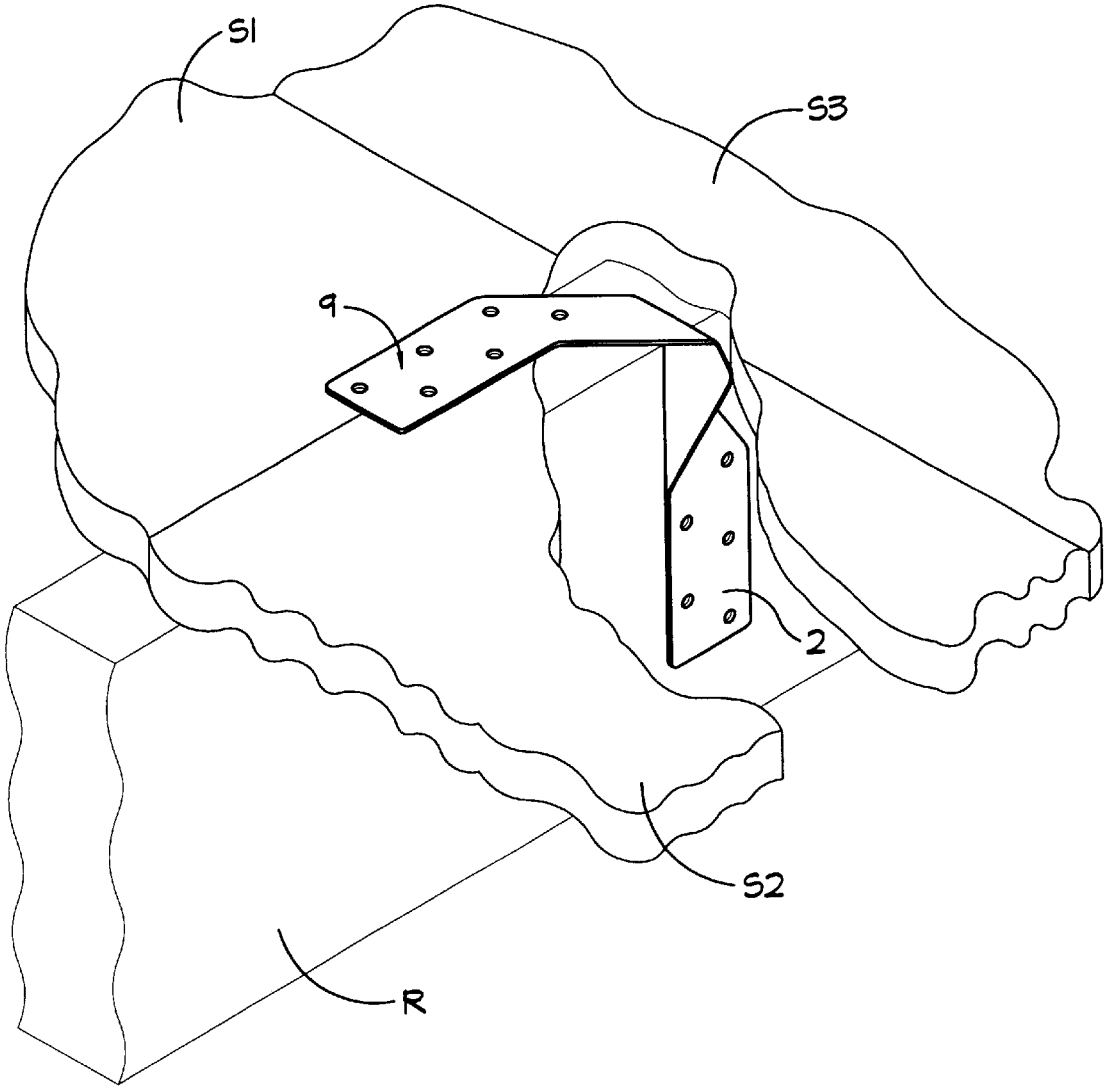
FIG. 2B is a perspective view of a right-hand universal sheathing tie mounted to a house.

Refer now to FIG. 2B which shows a perspective view of a right-hand universal sheathing tie 9. This is a right-hand tie because it is easier for a framer who is right-handed to nail the rafter web 2 into the rafter R. The rafter web 2 sticks out from underneath the sheathing sheets S1 and S2 for easy nailing, before being covered over by sheathing sheet S3.

The right-hand universal sheathing tie 9 is made from the same flat pattern layout as the left-hand universal sheathing tie 1. Referring to FIG. 1, the left-hand universal sheathing tie 1 is made by bending the normal web 4 up at the universal bend 5, and bending the rafter web 2 clockwise along the space bend 3. The right-hand universal sheathing tie 9 is made by bending the sheathing web 7 down at the universal bend 5, and bending the rafter web 2 up at the space bend 3.

FIG. 2C

Figure 2C:
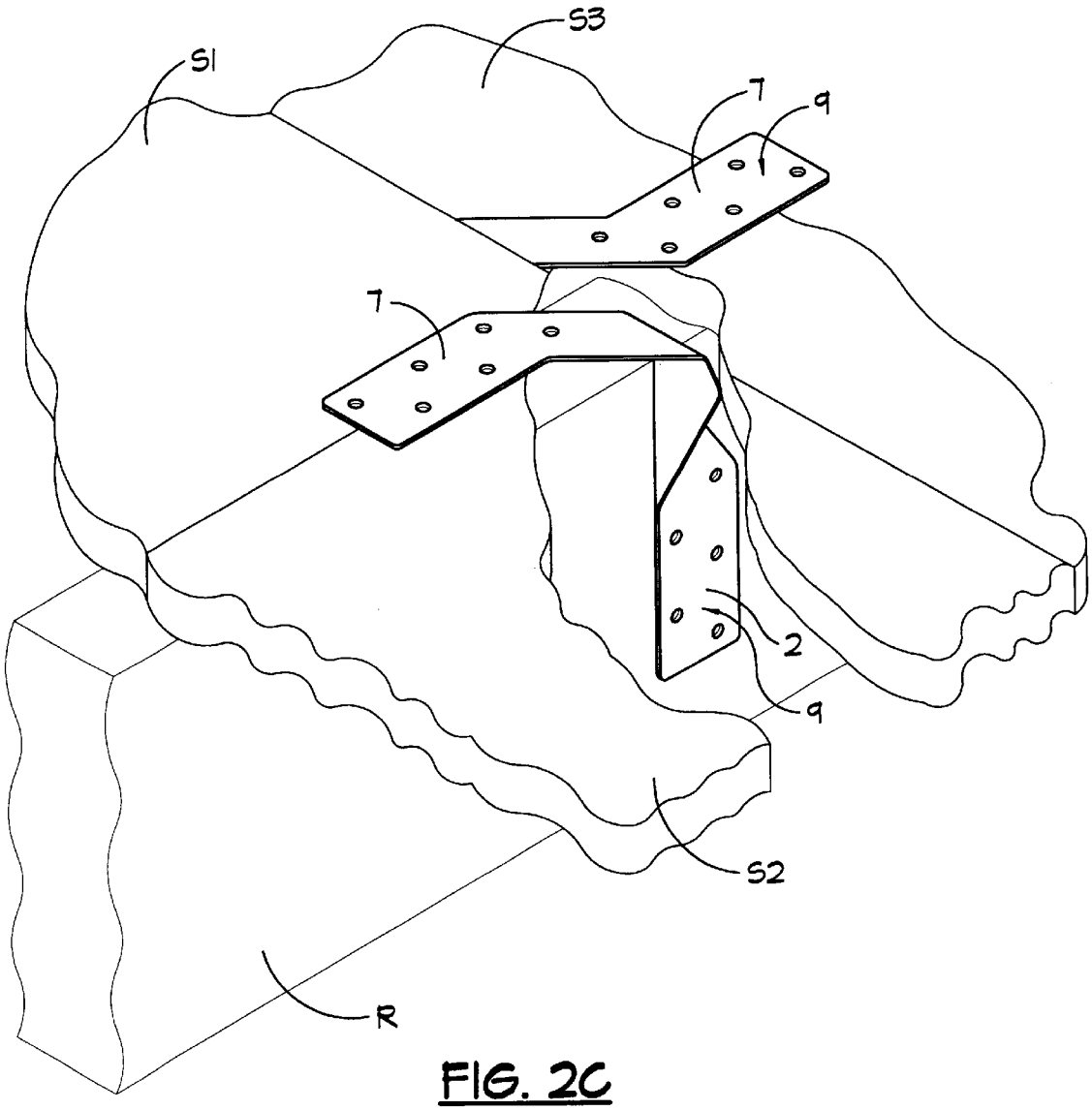
FIG. 2C is a perspective view of two right-hand universal sheathing ties mounted on a house.

Refer now to FIG. 2C which is a perspective view of two right-hand universal sheathing ties 9 mounted on a rafter and sheathing. In high-wind areas, besides securing the butt-edges of sheathing, the field area of sheathing may have to be held down.

Referring to FIG. 2C, a right-hand universal sheathing tie 9 is securing sheathing sheets S1 and S2 as stated for FIG. 2B. Before sheathing sheet S3 is installed, another right-hand universal sheathing tie 9 is installed so that the rafter web 2 (hidden in this view) is installed to the rafter R on the side opposite the tie facing the viewer.

Installing a right-hand universal sheathing tie 9 on the opposite side of a rafter forces the sheathing web 7 to face in the opposite direction. A scrap piece of sheathing can be inserted under the sheathing web 7 to space it correctly from the thin edge of the rafter. Then the rafter web 2 can be attached to the wide edge of the rafter R. The scrap piece of sheathing can be pulled out and a sheet of sheathing S3 can be slid under the sheathing web 7 and secured to the rafter R.

The rafter webs 2 of each right-hand universal sheathing tie 9 shown in FIG. 2C will not be directly across from each other so nails will not conflict with each other or split the wood.

FIG. 2D

Figure 2D:
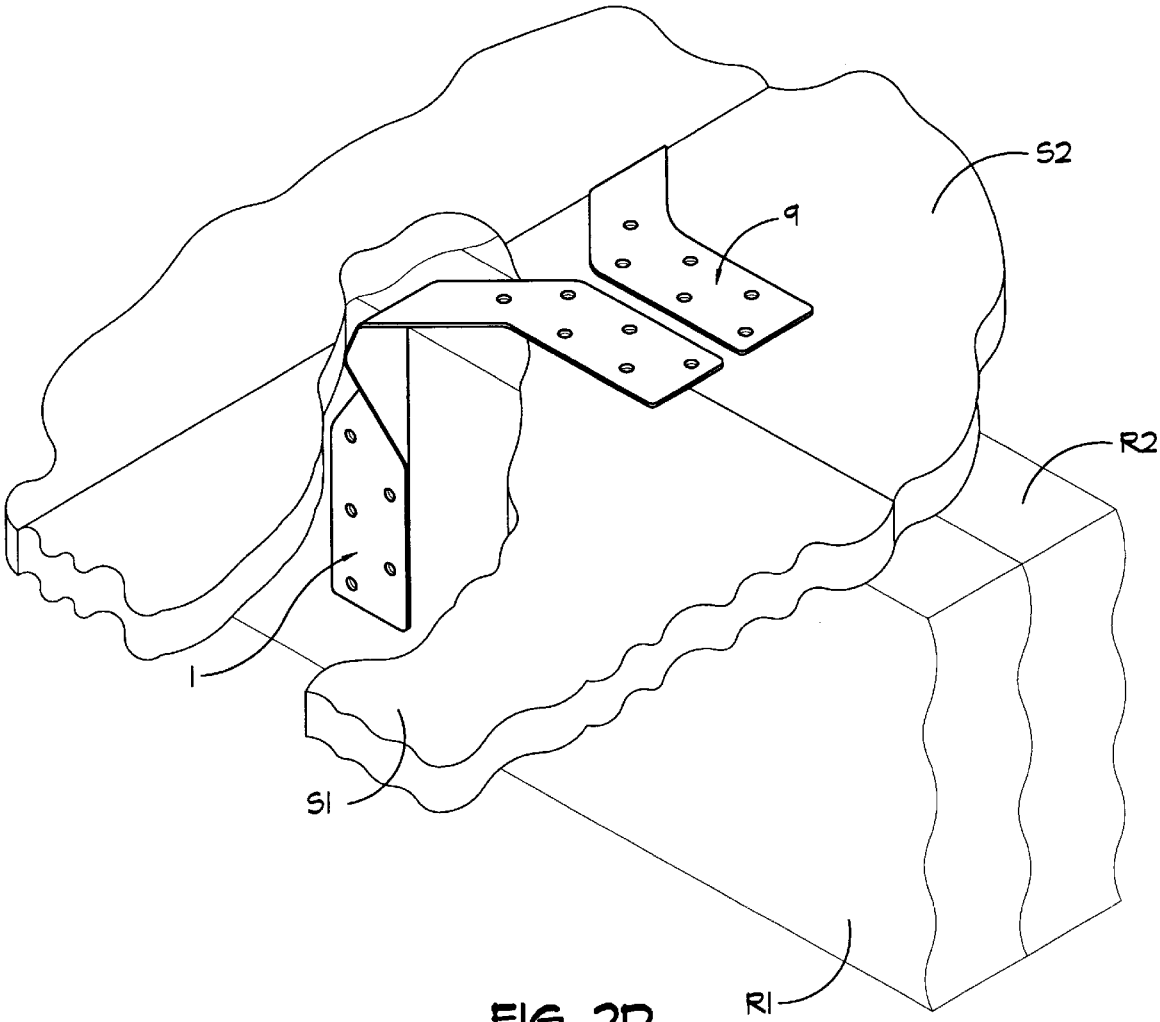
FIG. 2D is a perspective view of a right-hand and left hand universal sheathing ties mounted on a house.

Refer now to FIG. 2D which shows a perspective view of a right-hand and left-hand universal sheathing tie installed on a house. Rafters or roof trusses may be doubled-up for strength and this makes installing the sheathing correctly difficult.

Referring to FIG. 2D, there are two rafters R1 and R2. The left rafter R1 is spaced 24 inches-on-center with a doubled-up rafter R2 for added strength. Because rafters and roof trusses can bow, they may not be perfectly square to each other and there may be spaces between each other.

Sheathing sheets S1 and S2 are installed with the butt end over the left rafter R1. Some nails along the edge of sheet S2 may go down between the two rafters R1 and R2 and have less holding power against uplift. The left-hand universal sheathing tie 1 will hold down the edges of both sheathing sheets S1 and S2, but for added strength, a right-hand universal sheathing tie 9 can be installed on rafter R2 and sheathing sheet S2. The butt joints of sheathing sheets S1 and S2 could meet over the joints of the two rafters R1 and R2, and a left-hand and right-hand universal sheathing tie would secure the sheathing.

FIG. 3A

Figure 3A:
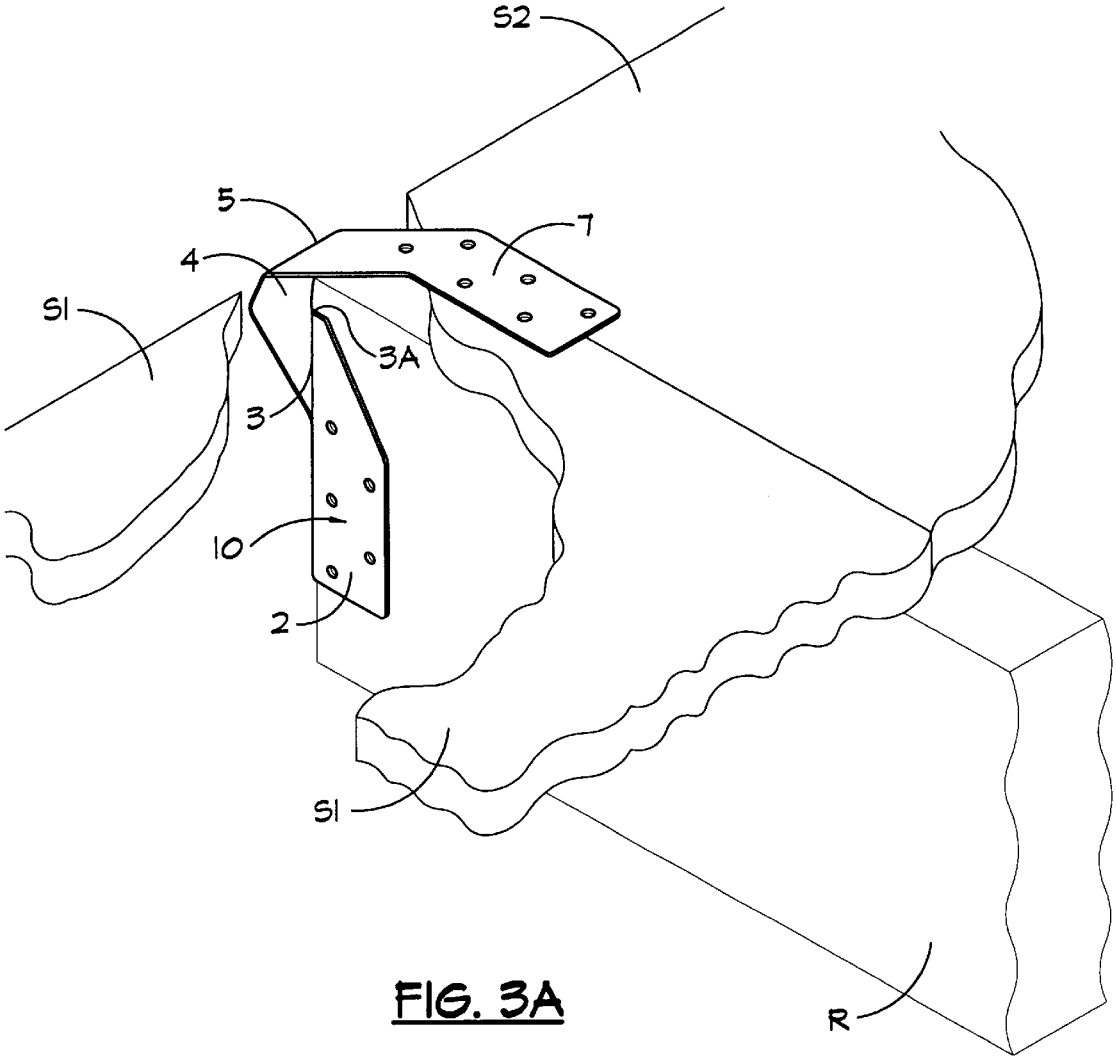
FIG. 3A is a perspective view of a reverse left-hand universal sheathing tie mounted on the end of a house.

Refer now to FIG. 3A which shows a perspective view of a reverse left-hand universal sheathing tie 10. This tie is bent from the flat pattern layout of FIG. 1 by bending the normal web 4 up at the universal bend 5, and bending the rafter web 2 clockwise at the space bend 3.

The reverse left-hand universal sheathing tie 10 can be installed on the end of a roof. The rafter web 2 sticks back under the sheathing S1 for attachment to the rafter R. Like the other sheathing ties 1 and 9, the reverse left-hand universal sheathing tie 10 can tie down two sheets of sheathing S1 and S2.

FIG. 3B

Figure 3B:
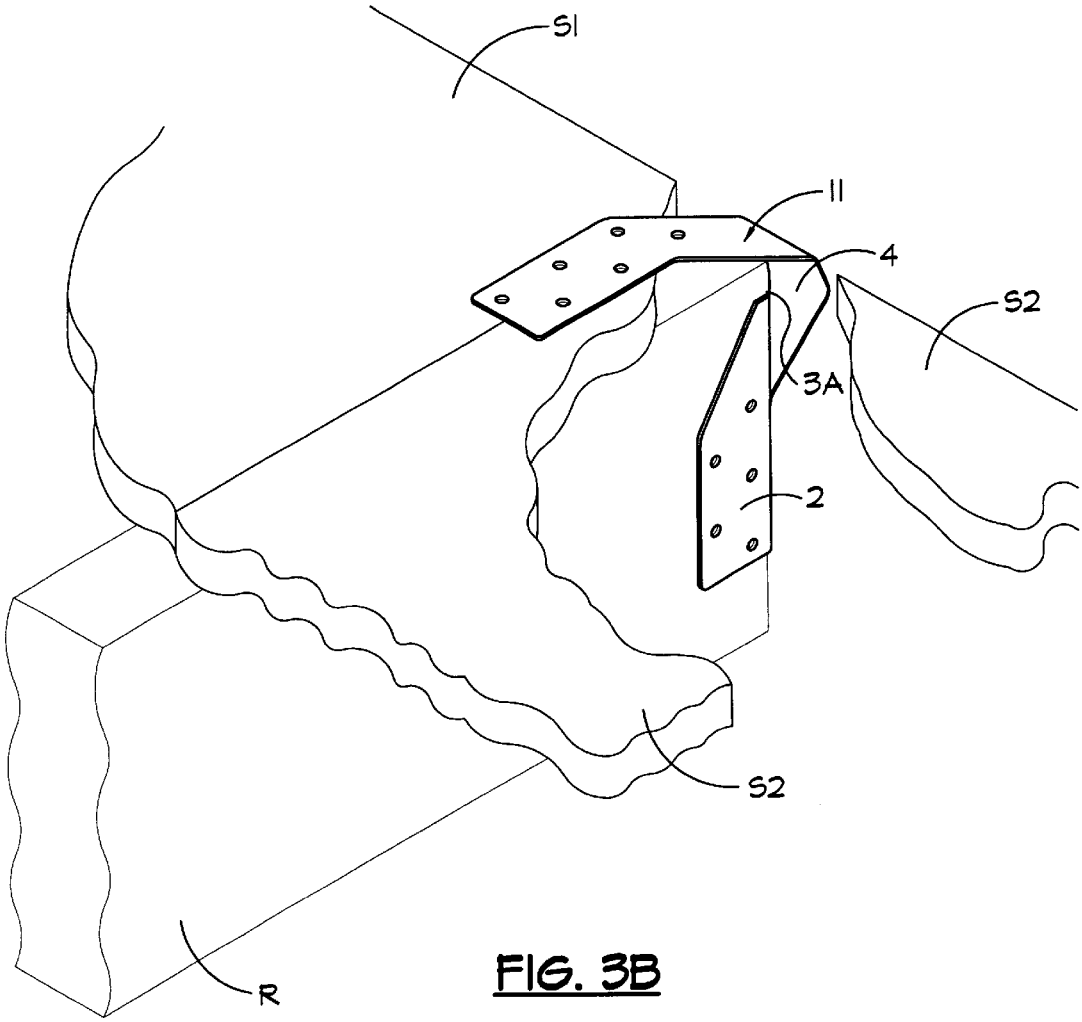
FIG. 3B. is a perspective view of a reverse right-hand universal sheathing tie mounted on a house.

Refer now to FIG. 3B which shows a reverse right-hand universal sheathing tie 11. This tie is bent from the flat pattern layout of FIG. 1 by bending the normal web 4 down at the universal bend 5, and bending the rafter web 2 counter-clockwise at the space bend 3, so the rafter web 2 is underneath the offset web 6.

The reverse right-hand universal sheathing tie 11 can be installed on the end of a roof. The rafter web 2 sticks back under the sheathing S1 for attachment to the rafter R. Like the other sheathing ties 1, 9, and 10. The reverse right-hand universal sheathing tie 11 can tie down two sheets of sheathing S1 and S2.

FIG. 4A

Figure 4A:
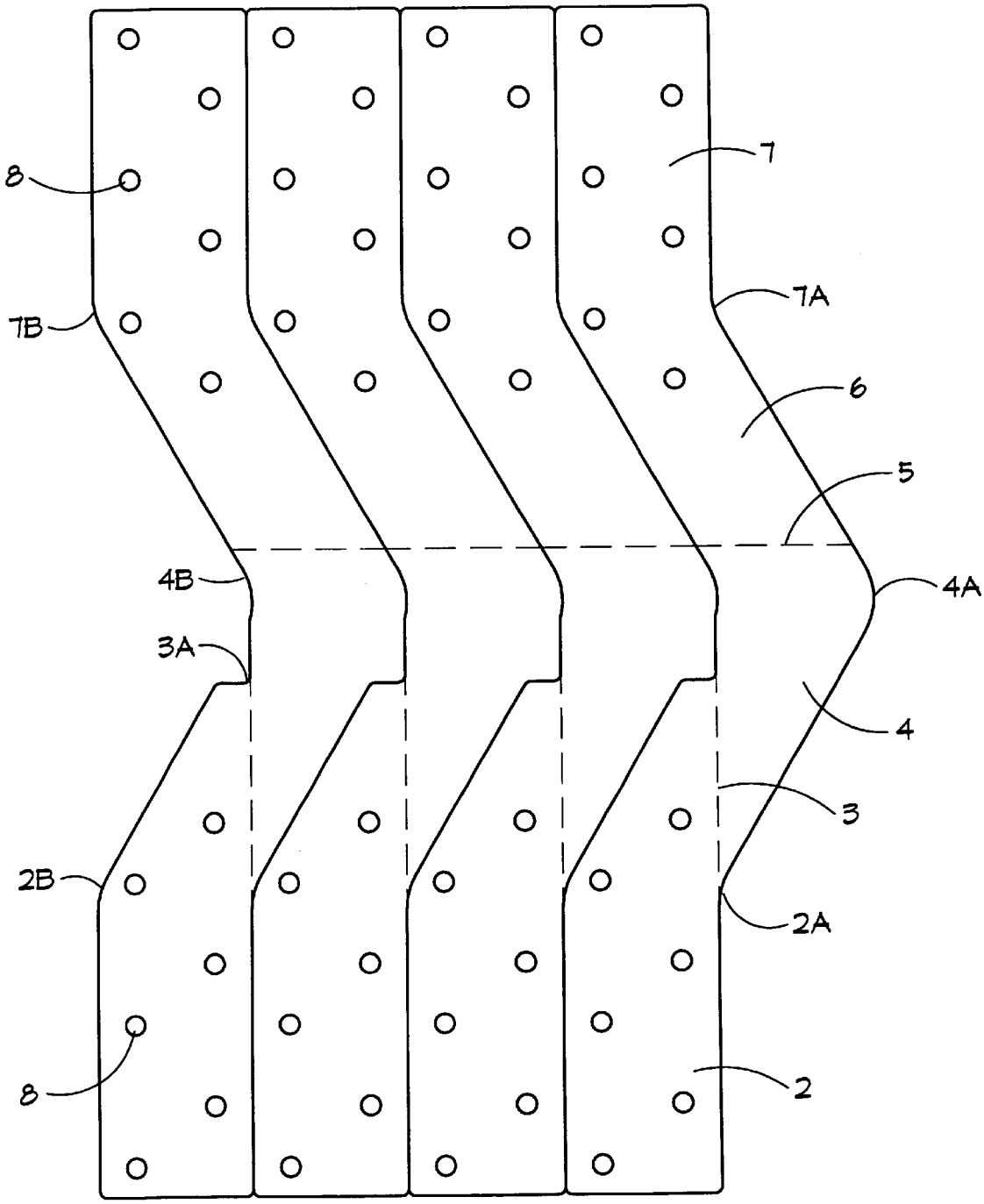
FIG. 4A is a flat pattern layout showing nesting.

Refer now to FIG. 4A which shows a flat pattern layout for tool and die methods where there is little waste in manufacture. Each universal sheathing tie nests next to each other so there is no wasted material during fabricating. The ties can then be formed by bending at the prescribed bends.

FIG. 4B

Figure 4B:
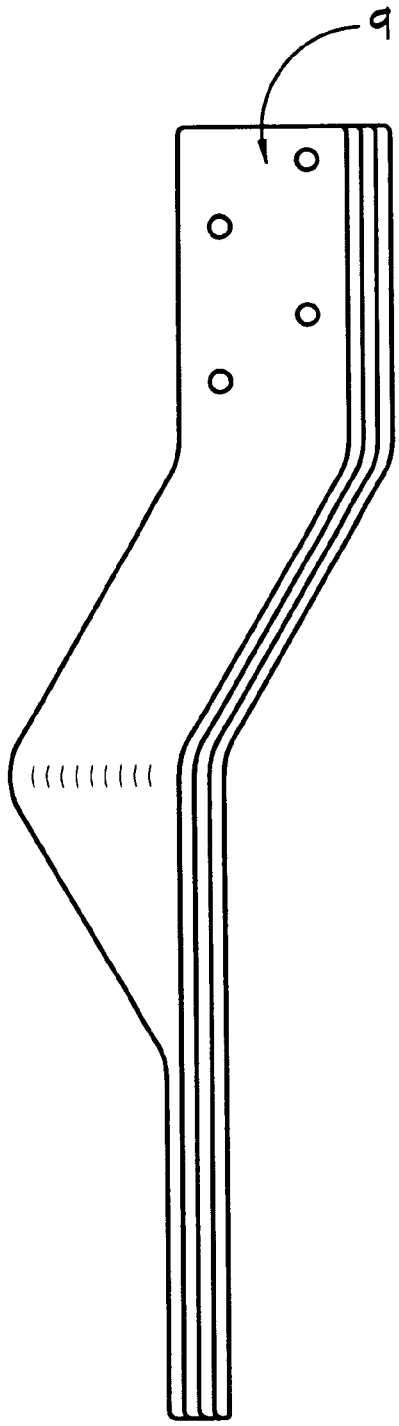
FIG. 4B is a side view showing nesting during shipping.

Refer now to FIG. 4B which shows a perspective view of nesting of the universal sheathing ties after manufacture. This saves space during boxing and shipping.

FIG. 5A

Figure 5A:
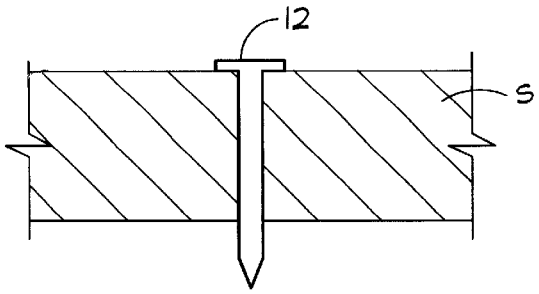
FIG. 5A is a cross section of a nail in sheathing.

Refer now to FIG. 5A which shows a cross section of a nail 12 through sheathing S and into a structural member. This is how a nail or screw would be normally inserted into sheathing.

FIG. 5B

Figure 5B:
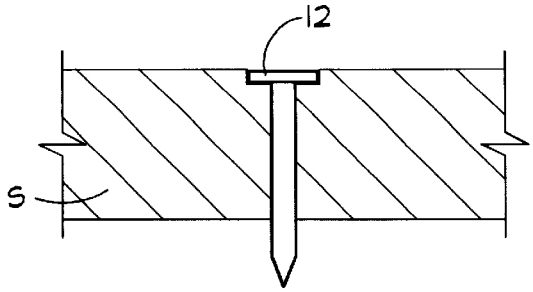
FIG. 5B is a cross section of a deep nail in sheathing.

Refer now to FIG. 5B which shows a cross section of a nail 12 through sheathing S and into a structural member. This shows what happens if the framer nails the nail with too much force or if the nail gun is set with too much pressure. This will tear the top veneer of plywood and significantly reduce the holding power of the nail.

FIG. 5B can also refer to Oriented Strand Board (OSB), that is commonly used as sheathing S, after it gets wet. When OSB gets wet it can swell. If it swells around the nail 12 as shown, the holding power of the nail is significantly reduced. Much of the sheathing blown off during Hurricane Andrew was OSB that got wet. OSB is no longer used in southern Florida as sheathing.

FIG. 5C

Figure 5C:
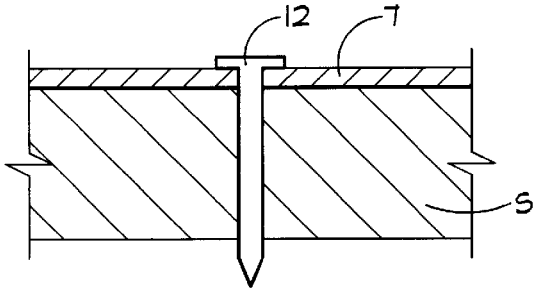
FIG. 5C is a cross section of a nail in a universal sheathing tie and sheathing.

Refer now to FIG. 5C which shows a cross section of a nail 12 holding down the sheathing web 7, of a universal sheathing tie, and sheathing S to a structural member. The nail 12 is inserted through a nail hole 8 on the sheathing web 7 and driven into the sheathing S and underlying structural member.

The large surface area of the sheathing web 7 forms a washer, spreading the hold down effect over a large area of the sheathing S. This helps prevent splitting and tearing of the sheathing since the head of the nail 12 cannot penetrate the plywood veneer as shown in FIG. 5B.

If OSB is used as sheathing, the large surface area of the sheathing web 7 will hold the sheathing S around the nail 12, preventing swelling. The universal sheathing tie significantly increases the holding power of nails or screws in sheathing.

FIG. 6A

Figure 6A:
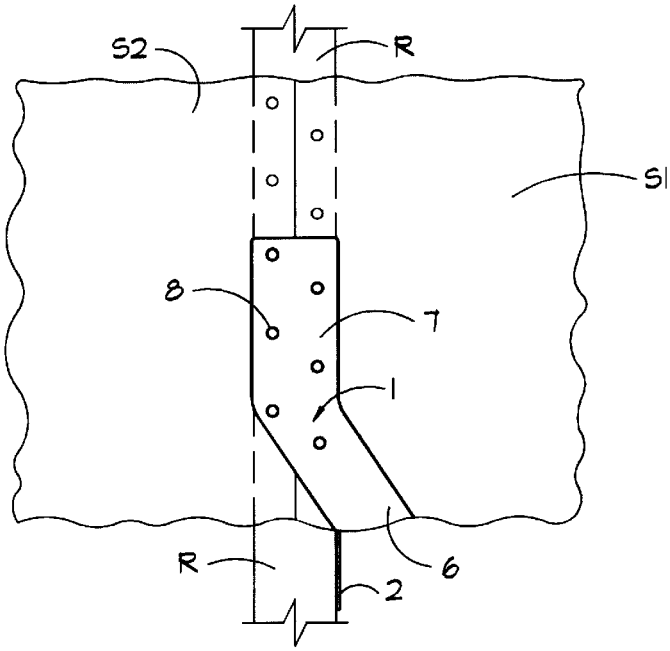
FIG. 6A is a top view of a left-hand universal sheathing tie installed on two sheets of sheathing.

Refer now to FIG. 6A which shows a top view of a left-hand universal sheathing tie 1 holding down two sheets of sheathing S1 and S2 to a structural member R. This view shows the wide surface area of the sheathing web 7 and how it is able to tie down both edges of sheathing S1 and S2 to the structural member R. In an earthquake, this would prevent the edges of the sheathing from moving past each other creating a strong shearwall.

The nails holding down the sheathing sheets above the left-hand universal sheathing tie 1 are now correctly placed in the sheathing and structural member. The structural member could be a rafter, wall stud, or floor joist. If a skylight, window, or door was to be installed on the right side of the structural member, a right-hand universal sheathing tie 9 could be installed instead.

FIG. 6B

Figure 6B:
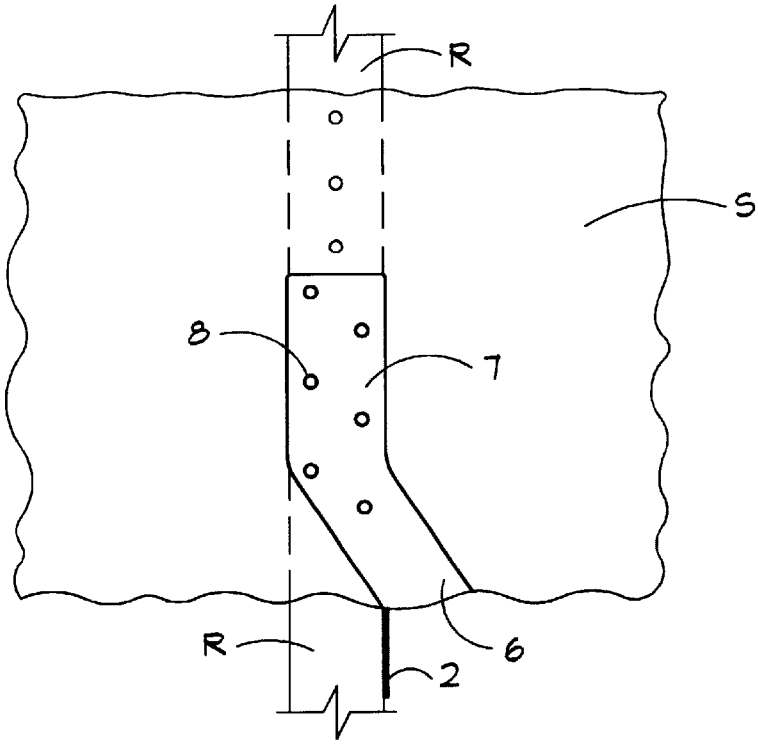
FIG. 6B is a top view of a left-hand universal sheathing tie installed on one sheet of sheathing.

Refer now to FIG. 6B which shows a top view of a left-hand universal sheathing tie 1 holding down one sheet of sheathing S to a structural member R. When a large sheet of sheathing is lifted into place, the interior or field section of the sheathing hides the structural member. This makes accurate nailing of the interior sheathing into the thin edge of the structural member difficult. Some nails may hit the edge of the structural member or miss it entirely.

The universal sheathing tie 1 provides a line of sight for the underlying structural member R because the sheathing web 7 is directly over the structural member. This makes it easy to install the field nails directly into the structural member. So besides the powerful holding power of the universal sheathing tie, it also helps align nailing of the field, adding even more hold down strength.

FIG. 7

Figure 7:
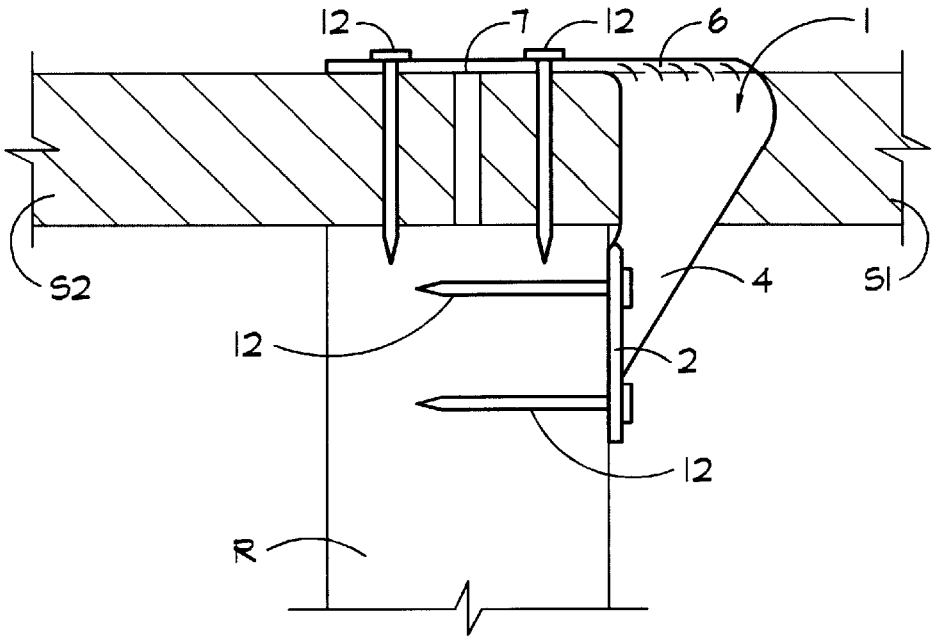
FIG. 7 is a cross section of a left-hand universal sheathing tie installed on two sheets of sheathing.

Refer now to FIG. 7 which shows a cross section through a left-hand universal sheathing tie 1 that is holding down two sheets of sheathing S1 and S2 to a structural member R. The sheathing sheets can be thick or thin, since they will fit under the sheathing web 7.

If thinner sheets of sheathing were used than those shown, the rafter web 2 would be installed further down on the structural member R, pulling the sheathing web 7 tight against the thinner sheathing.

If thicker sheets of sheathing were used than those shown, the rafter web 2 would be installed further up on the structural member R, pulling the sheathing web 7 tight against the thicker sheathing.

The universal sheathing tie can be installed on different widths of structural members, such as 2×4's, 2×6's, 2×8's, etc. The thickness of the structural member remains the same, but the width changes. Referring to FIG. 7, it can be seen that the structural member R can extend down off the page, but the rafter web 2 will still tie into the strong width of the structural member R.

Conclusion, Ramifications, and Scope

Thus, the reader will see that the sheathing tie of the invention provides a simple and economical connector that allows a builder to quickly, easily, and accurately secure sheathing of a building against earth tremors and high winds.

While my above description contains many specificities, these should not be construed as limitations on the scope of the invention, but rather as an exemplification of one preferred embodiment thereof. Many other variations are possible.

There can be minor variations in size, and materials. For example, the ties can have more rounded corners, squarer corners, wavy lines instead of straight lines, more nailholes, slightly less nailholes, or be thicker or thinner, wider or longer.

The ties can hold down boards instead of sheathing; they can also hold down insulated sheets or metal sheets. If the sheathing webs were formed with waves, they could hold down corrugated metal and fiberglass roofs.

The ties can have a variety of shapes stamped in the sheathing webs to hold down a variety of objects against sheathing such as wires, pipes, or structural mounts for solar energy and satellite dishes.

The rafter webs can be formed curved or roundish in order to fit about circular beams and timbers such as in log cabins and adobe homes.

The ties can be wrapped around different types of structural members including wood, plastic, metal, concrete, or light-weight composite materials. The ties can hold down different types of sheathing including wood, glass, plastic, metal, concrete, slate, and mane-made materials.

The ties can be made of metal by stamping, forging, or casting. The ties can be made of plastic, by molding or casting. The ties can be made of recycled materials. The ties can be made with bright colors, so a builder or inspector knows they are in position. They can be of different thicknesses, where the gap between each sheet has to be a specific distance.

Accordingly, the scope of the invention should be determined not by the embodiments illustrated, but by the appended claims and their legal equivalents.

I claim:

1. A connector for preventing sheathing on a wood frame building from separating from underlying structural members during strong winds and earth tremors comprising:

a. a rafter web attached to a lower jog;

b. a normal web attached to said rafter web, at said jog, by a first generally right angle bend;

c. an offset web attached to said normal web by a second generally right angle bend and middle joggle;

d. a sheathing web attached to said offset web by an upper jog.

2. The connector of claim 1 wherein said rafter web having a generally truncated triangular shape, flat surface, and plurality of nail holes as a means for attachment to a generally vertical face of a structural member of a building.

3. The connector of claim 1 wherein said rafter web having said first generally right angled bend generally parallel and generally adjacent to one side of said rafter web.

4. The connector of claim 1 wherein said normal web having a generally triangular shape, and said second generally right angled bend, generally perpendicular and adjacent to said first generally right angled bend, forming a base of said triangle.

5. The connector of claim 1 wherein said normal web having a relief cut on said vertical side, a general extension of said first generally right angle bend, and a middle joggle as a means of placement against a thin edge of sheathing.

6. The connector of claim 1 wherein said offset web having a general parallelogram shape and said second right angle bend on one short end and a jog on the other as a means for locating said sheathing web generally perpendicular and generally aligned to said rafter web.

7. The connector of claim 1 wherein said sheathing web having general aligment with said rafter web, and a generally rectangular shape and a plurality of nail holes as a means of attachment to said sheathing and underlying structural member.

8. The connector of claim 1 wherein said connector having said webs, a plurality of nail holes, as a means for securing sheathing having standard dimensions and odd dimensions.

9. The connector of claim 1 wherein said connector having securing fasteners in shear between said sheathing and said structural member as a means of preventing uplift and lateral loads as would occur during high winds and seismic movements.

10. The connector of claim 1 wherein said generally right angle bend, having proficiency of bending in different dimensions as a means of forming different connectors from the same blank to fit on different parts of a building.

* * * * *